US011008828B2

(12) United States Patent
Kræmer

(10) Patent No.: US 11,008,828 B2
(45) Date of Patent: May 18, 2021

(54) COMPLETION METHOD AND COMPLETION SYSTEM

(71) Applicant: Welltec Oilfield Solutions AG, Zug (CH)

(72) Inventor: Jon Kræmer, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 105 days.

(21) Appl. No.: 16/264,841

(22) Filed: Feb. 1, 2019

(65) Prior Publication Data

US 2019/0242212 A1 Aug. 8, 2019

(30) Foreign Application Priority Data

Feb. 2, 2018 (EP) ..... 18154968

(51) Int. Cl.

| | |
|---|---|
| ***E21B 33/14*** | (2006.01) |
| ***E21B 43/10*** | (2006.01) |
| ***E21B 33/127*** | (2006.01) |
| ***E21B 34/06*** | (2006.01) |
| *E21B 47/06* | (2012.01) |

(52) U.S. Cl.

CPC ..... *E21B 33/14* (2013.01); *E21B 33/127* (2013.01); *E21B 34/063* (2013.01); *E21B 43/10* (2013.01); *E21B 47/06* (2013.01)

(58) Field of Classification Search

CPC ..... E21B 33/13; E21B 33/14; E21B 33/127; E21B 34/063

See application file for complete search history.

(56) References Cited

U.S. PATENT DOCUMENTS 3,948,322 A * 4/1976 Baker ..... E21B 33/16 166/289
4,655,286 A * 4/1987 Wood ..... E21B 33/1243 166/184
4,711,301 A * 12/1987 Stringfellow ..... E21B 33/127 166/187

(Continued)

FOREIGN PATENT DOCUMENTS

EP 3 159 478 4/2017

OTHER PUBLICATIONS

Extended Search Report for EP18154968.4 dated Jul. 26, 2018, 6 pages.

*Primary Examiner* — Robert E Fuller
(74) *Attorney, Agent, or Firm* — Nixon & Vanderhye P.C.

(57) ABSTRACT

A completion method for completing a well includes running of a second well tubular metal structure into the well to a position at least partly below a first well tubular metal structure, circulating cleaning fluid at a first pressure out through the second end to remove at least part of the mud, displacing cement at a second pressure down through the second well tubular metal structure into an annulus between the second well tubular metal structure and a wall of the borehole, pressurising the inside of the second well tubular metal structure to a third pressure above the first pressure and the second pressure breaking a breakable element in the valve assembly, which changes condition from the first condition to the second condition, further pressurising the inside of the second well tubular metal structure, expanding the expandable metal sleeve to abut the wall of the borehole.

22 Claims, 7 Drawing Sheets

(56) References Cited

U.S. PATENT DOCUMENTS

| | | | | | |
|---|---|---|---|---|---|
| 5,024,273 | A * | 6/1991 | Coone | E21B 33/127 | 166/154 |
| 5,400,855 | A * | 3/1995 | Stepp | E21B 33/127 | 166/151 |
| 7,284,619 | B2 * | 10/2007 | Stokley | E21B 33/146 | 166/387 |
| 9,500,063 | B2 * | 11/2016 | Greenan | E21B 34/00 | |
| 10,156,124 | B2 * | 12/2018 | Guzman | E21B 34/10 | |
| 10,619,447 | B2 * | 4/2020 | Kelley | E21B 34/10 | |
| 2015/0330181 | A1 * | 11/2015 | Budde | E21B 33/16 | 166/289 |
| 2017/0211347 | A1 | 7/2017 | Vasques | | |

* cited by examiner

COMPLETION METHOD AND COMPLETION SYSTEM

CROSS REFERENCE TO RELATED APPLICATION

This application claims priority to EP Patent Application No. 18154968.4 filed Feb. 2, 2018, the entire contents of which are hereby incorporated by reference.

BACKGROUND OF THE INVENTION

The present invention relates to a completion method for completing a well having a top. The present invention also relates to a completion system for completing a well having a top.

BRIEF SUMMARY OF THE INVENTION

In order to prevent blowouts, security comes first when completing a well. This also ensures that the well fluid does not pollute the environment. Although focus is put on completing the well as quickly as possible and developing completion in order to minimise the completion steps, focus is also put on not jeopardising the security.

It is an object of the present invention to wholly or partly overcome the above disadvantages and drawbacks of the prior art. More specifically, it is an object to provide an improved completion method and completion system without jeopardising the security.

The above objects, together with numerous other objects, advantages and features, which will become evident from the below description, are accomplished by a solution in accordance with the present invention by a completion method for completing a well having a top, comprising:

drilling a borehole below a first well tubular metal structure in the well, circulating mud at least partly while drilling the borehole, providing a second well tubular metal structure having at least one unexpanded annular barrier having a tubular part surrounded by an expandable metal sleeve, expandable by means of pressurised fluid from within the second well tubular metal structure through a valve assembly into an annular space between the tubular part and the expandable metal sleeve, the second well tubular metal structure having a first end closest to the top and a second end, the valve assembly having a first condition in which fluid communication between an inside of the second well tubular metal structure and the space is disconnected, and having a second condition allowing fluid communication between the inside of the second well tubular metal structure and the annular space, running of the second well tubular metal structure into the well to a position at least partly below the first well tubular metal structure, circulating cleaning fluid at a first pressure out through the second end to remove at least part of the mud, displacing cement at a second pressure down through the second well tubular metal structure and out through the second end into an annulus between the second well tubular metal structure and a wall of the borehole, pressurising the inside of the second well tubular metal structure to a third pressure above the first pressure and the second pressure breaking a breakable element in the valve assembly, which changes condition from the first condition to the second condition, and further pressurising the inside of the second well tubular metal structure, expanding the expandable metal sleeve to abut the wall of the borehole.

Furthermore, the first pressure may be substantially equal to the second pressure.

Also, the completion method may further comprise cleaning out mud by circulating the mud out through the second end of the second well tubular metal structure.

Hereby, it is obtained that the annular barrier will not expand unintentionally when performing operations, such as cleaning and cementing at certain pressures, in which it is ensured that e.g. the cementing can be performed as intended without prematurely expanded annular barriers blocking the annulus. Thus, cement may be run with pressure activated valves opposite the expansion opening in an annular barrier in its closed position, and the valves may be activated/opened when a certain pressure is reached, i.e. breaking a shear pin, so that the valve does not open before the cement job has ended and so that the annular barrier is not expanded too soon.

The valve assembly may comprise a first piston movable in a first bore from the first condition to the second condition, the first piston being maintained in the first condition by means of the breakable element.

Moreover, the completion method may further comprise introducing displacement fluid, such as brine or similar lightweight fluid, on top of the cement to displace the cement through the second well tubular metal structure.

Also, displacing cement may be performed by displacing a wiper plug.

Furthermore, displacing cement may be performed by displacing a top wiper plug on top of the cement and the wiper plug below the cement.

In addition, the valve assembly may have a retainer element energised with a retainer spring for locking the first piston in the second position.

The completion method according to the present invention may further comprise running of the second well tubular metal structure being performed by connecting a drill pipe to the first end of the second well tubular metal structure.

Said completion method may further comprise disconnecting the drill pipe subsequent to expanding the expandable metal sleeve.

The completion method according to the present invention may further comprise determining the first pressure.

Further, the determination of the first pressure may be based on e.g. cement type, annulus size, and height.

The completion method according to the present invention may further comprise introducing displacement fluid, such as brine or similar lightweight fluid, on top of the cement or the wiper plug in order to displace the cement.

Said completion method may further comprise introducing heavy fluid on top of lightweight fluid (which is on top of cement) to be able to control the well later on.

Also, the completion method may further comprise rotating while running the second well tubular metal structure into the borehole.

The completion method according to the present invention may further comprise running a production tubing into the well to a position partly overlapping or above the second well tubular metal structure.

Moreover, the annular space may be vented to the annulus while running the second well tubular metal structure.

The present invention also relates to a completion system for completing a well having a top, comprising:

a borehole, a first well tubular metal structure, a second well tubular metal structure comprising at least one annular barrier having a tubular part mounted as part of the second well tubular metal structure and surrounded by an expandable metal sleeve, expandable by means of pressurised fluid from within the second well tubular metal structure through a valve assembly into an annular space between the tubular part and the expandable metal sleeve, the second well tubular metal structure having a first end closest to the top and a second end, the valve assembly having a first condition in which fluid communication between an inside of the second well tubular metal structure and the annular space is disconnected, and having a second condition allowing fluid communication between the inside of the second well tubular metal structure and the annular space, a first delivering means for delivering cleanout fluid at a first pressure through the second well tubular metal structure, and a second delivering means for delivering cement at a second pressure through the second well tubular metal structure, wherein the valve assembly comprises a breakable element breakable at a third pressure being higher than that of the first pressure and of the second pressure, enabling the valve assembly to change from the first condition to the second condition.

The first condition may be a first position and the second condition may be a second position, and the valve assembly may comprise a first piston moving in a first bore between the first position and the second position, the first piston being maintained in the first position by means of the breakable element, and the first bore having a first opening in fluid communication with an inside of the second well tubular metal structure, and a second opening in fluid communication with the annular space.

Also, the spring element may be arranged in the first bore configured to be compressed when the first piston moves from the first position to the second position.

Said first bore may have a third opening in fluid communication with the annulus for venting of pressure in the annular space to the annulus when the first piston is in the first position.

Furthermore, the valve assembly may have a second piston moving in a second bore between a first position and a second position, the second bore having a first opening in fluid communication with the second opening of the first bore, and the second bore having a second opening in fluid communication with the annular space.

Moreover, the second bore may have a third opening in fluid communication with the annulus for venting of pressure in the annular space to the annulus when the second piston is in the second position.

Also, the valve assembly may have a second breakable element for maintaining the second piston in the first position.

The completion system may comprise a wiper plug.

Further, the completion system may comprise a top wiper plug on top of the cement and the wiper plug below the cement.

The valve assembly may have a retainer element energised with a retainer spring for locking the first piston in the second position.

In addition, the second well tubular metal structure may comprise a plurality of annular barriers.

Finally, an inflow control device may be arranged between two adjacent annular barriers.

BRIEF DESCRIPTION OF THE DRAWINGS

The invention and its many advantages will be described in more detail below with reference to the accompanying schematic drawings, which for the purpose of illustration show some non-limiting embodiments and in which.

DETAILED DESCRIPTION OF THE INVENTION

All the figures are highly schematic and not necessarily to scale, and they show only those parts which are necessary in order to elucidate the invention, other parts being omitted or merely suggested.

Figure 1:
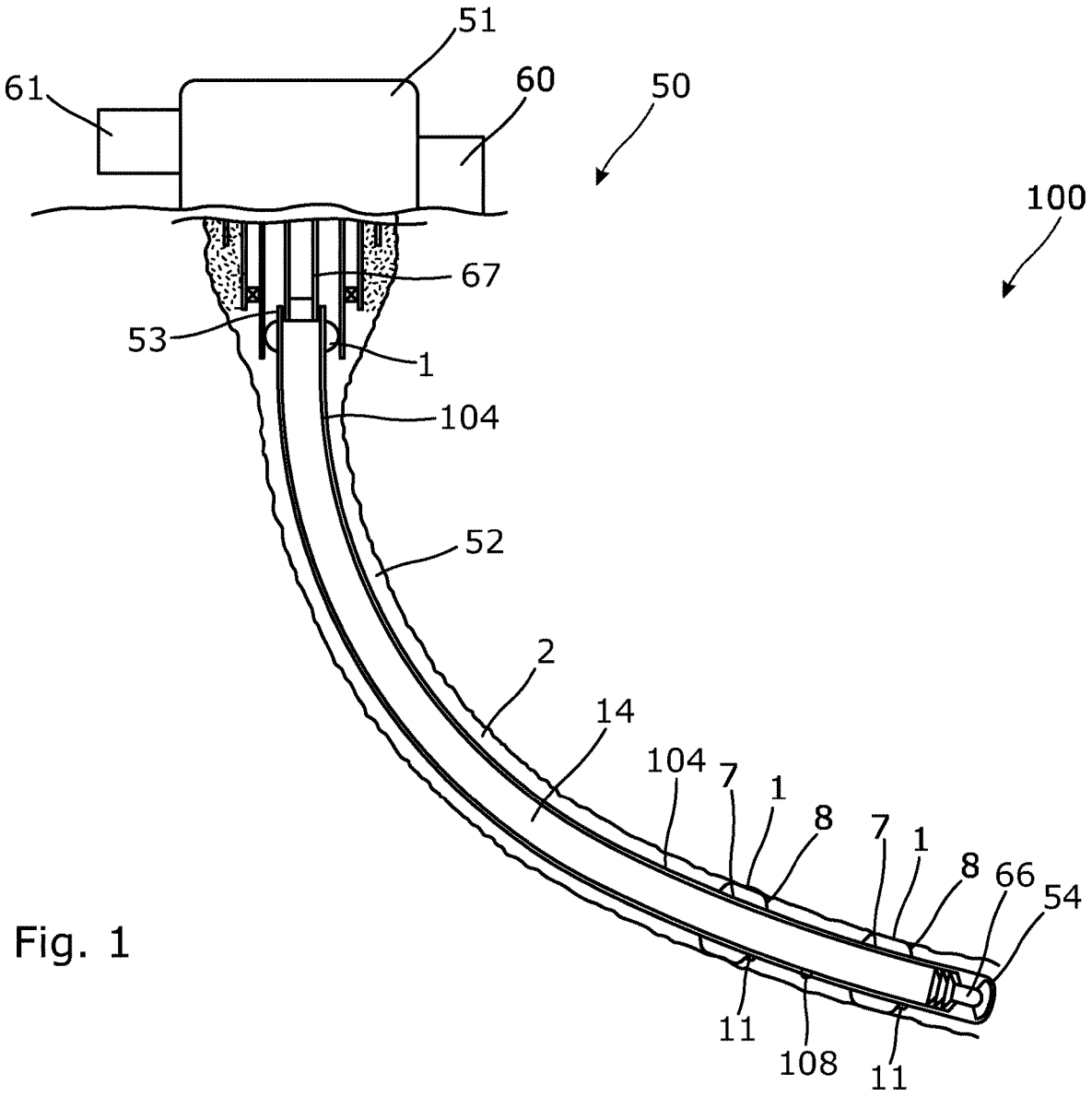
FIG. 1 shows a partly cross-sectional view of a downhole completion.
Figure 2:
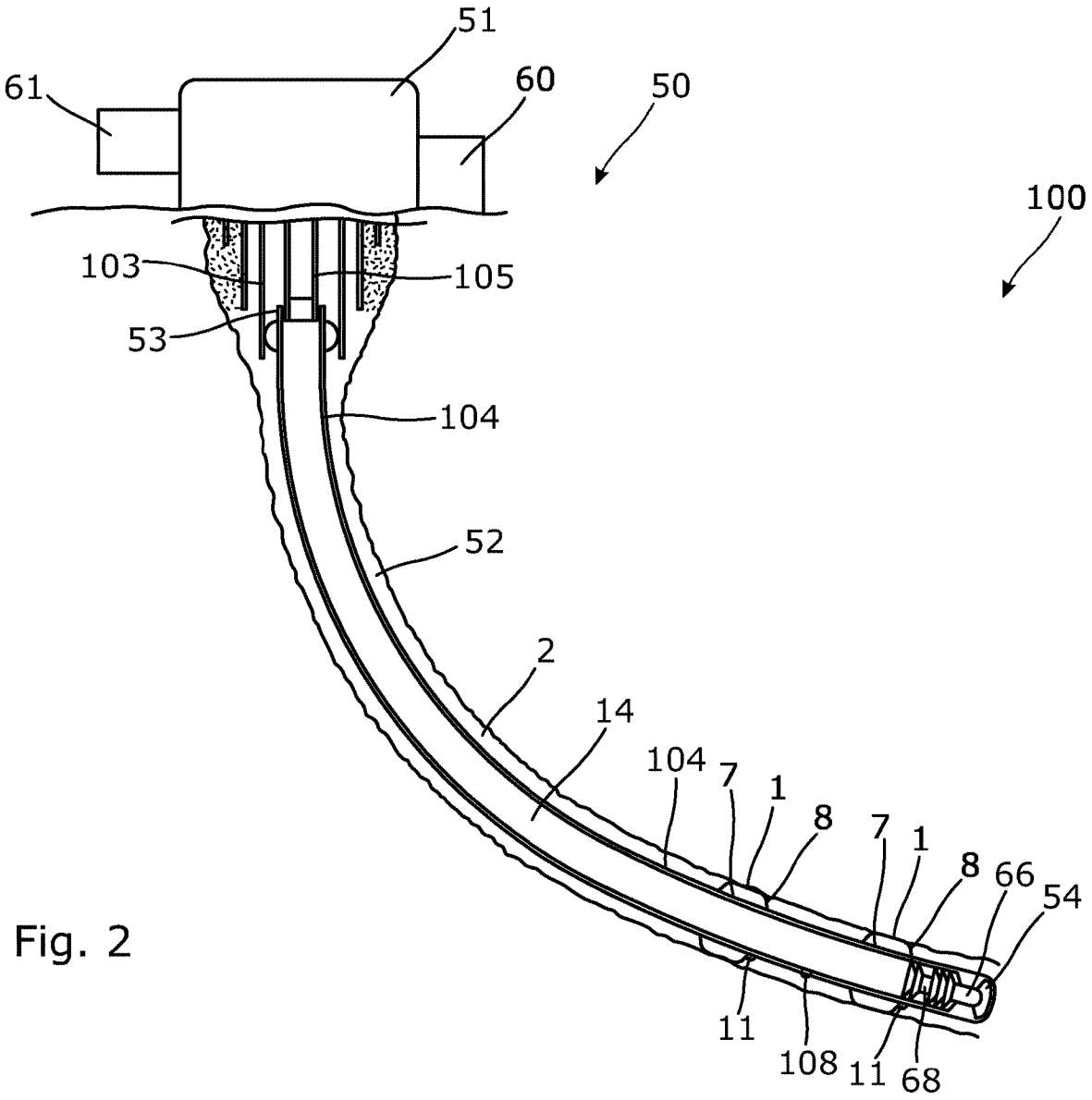
FIG. 2 shows a partly cross-sectional view of another downhole completion.

FIGS. 1 and 2 show a completion system 100 for completing a well 50 having a top 51. The completion system 100 comprises a borehole 52, a first well tubular metal structure 103, and a second well tubular metal structure 104. The second well tubular metal structure comprises at least one annular barrier 1 having a tubular part 7 mounted as part of the second well tubular metal structure. The tubular part is made of metal and is surrounded by an expandable metal sleeve 8, which is expandable by means of pressurised fluid from within the second well tubular metal structure through a valve assembly 11 into an annular space 15 (shown in FIG. 3) between the tubular part and the expandable metal sleeve 8. The second well tubular metal structure 104 has a first end 53 closest to the top and a second end 54. The valve assembly has a first condition in which fluid communication between an inside 14 of the second well tubular metal structure and the annular space is disconnected, and the valve assembly has a second condition allowing fluid communication between the inside 14 of the second well tubular metal structure and the annular space. The completion system further comprises a first delivering means 60 for delivering cleanout fluid at a first pressure through the second well tubular metal structure, and a second delivering means 61 for delivering cement at a second pressure through the second well tubular metal structure. The valve assembly comprises a breakable element 24 (shown in FIG. 4) breakable at a third pressure which is higher than that of the first pressure and the second pressure, enabling the valve assembly to change from the first condition to the second condition.

When completing the well, the completion method comprises the drilling of a borehole 52 below the first well tubular metal structure 103 in the well, circulating mud, at least partly while drilling the borehole, and providing a second well tubular metal structure 104 and running of the second well tubular metal structure into the well to a position at least partly below the first well tubular metal structure, normally while rotating the second well tubular metal structure. After the second well tubular metal structure is run in hole (RIH), the method comprises circulating cleaning fluid at a first pressure out through the second end of the second well tubular metal structure in order to remove the mud, which is also found in an annulus 2 between the well tubular metal structure and a wall 5 of the borehole. After the cleanout, the method comprises displacing cement at a second pressure down through the second well tubular metal structure and out through the second end into the annulus 2. During the step of cementing, the valve assembly is in its first position so that cement does not enter the space of the annular barrier and thus does not expand the expandable metal sleeve too soon, i.e. before the cementing process has ended. If the annular barrier is expanded too soon, the annular barrier provides an annular barrier in the annulus which hinders fluid from passing through, and circulation of cement is thus no longer possible, as the fluid displaced by the cement, or the cement itself, cannot pass the expanded annular barrier. After cementing, the method comprises pressurising the inside of the second well tubular metal structure to a third pressure above the first pressure and the second pressure, causing a breakable element 24 to break in the valve assembly. This changes the condition from the first condition to the second condition, and then by further pressurising the inside of the second well tubular metal structure, the expandable metal sleeves are expanded to abut the wall of the borehole.

As shown in FIG. 1, the second well tubular metal structure of the completion system is run in hole by means of a drill pipe 67 connected to the first end of the second well tubular metal structure 104. The cement is displaced down the second well tubular metal structure 104 by means of a wiper plug 66 which lands in the second end 54 and which closes the second well tubular metal structure. The inside of the second well tubular metal structure is then pressurised, first opening the valve assembly to change condition to the second condition, and then expanding the expandable metal sleeve 8 of the annular barriers 1. Subsequently, the drill pipe 67 is disconnected and a production tubing 105 is run, and e.g. partly overlapping the second well tubular metal structure as shown in FIG. 2 or arranged above the second well tubular metal structure 104 with an annular barrier between the outer face of the production tubing and the inner face of the first well tubular metal structure 103.

Figure 3:
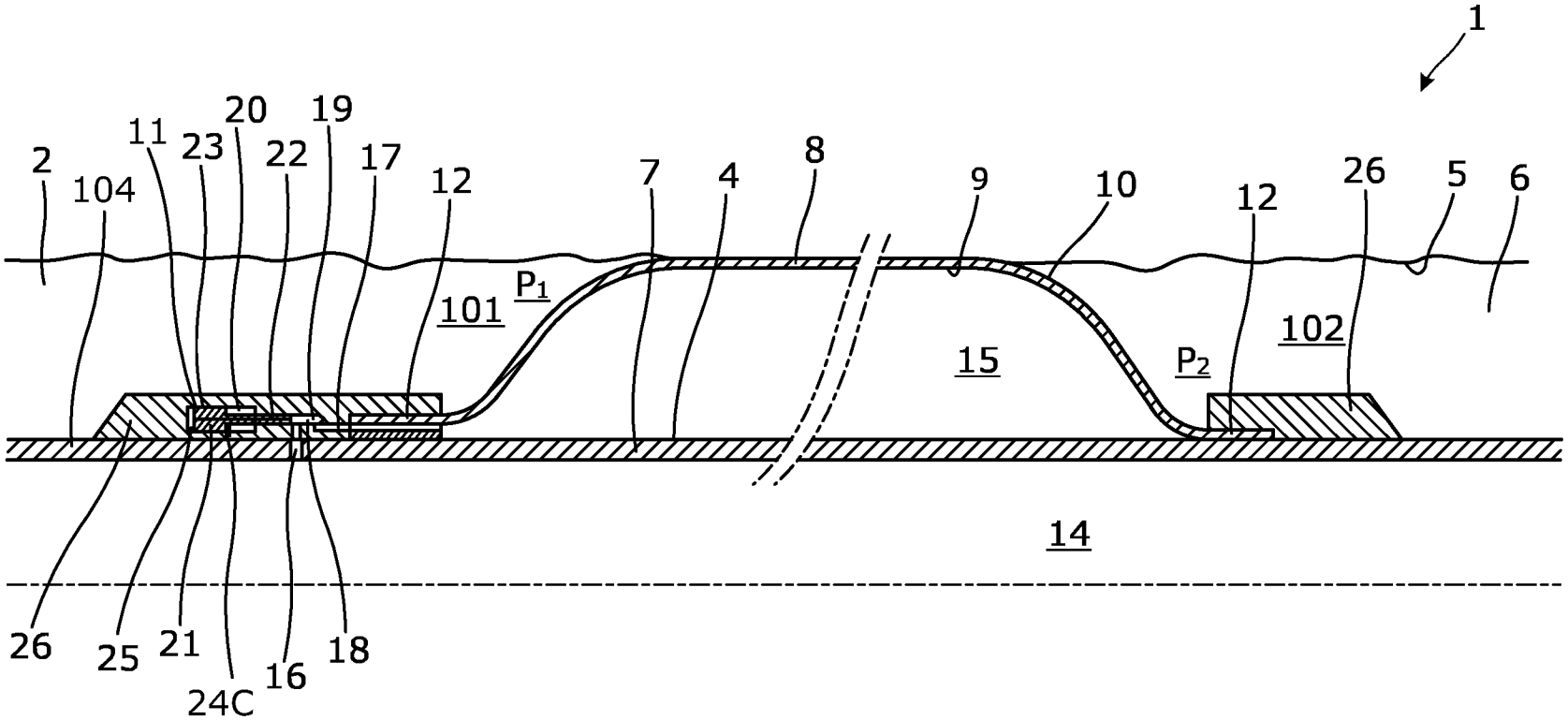
FIG. 3 shows a cross-sectional view of an annular barrier having a valve assembly.

In FIG. 3, an annular barrier 1 is shown in its expanded condition and the valve assembly is thus shown in its second condition. The annular barrier 1 is expanded in the annulus 2 between the second well tubular metal structure 104 and a wall 5 of a borehole 6 downhole, in order to provide zone isolation between a first zone 101 having a first pressure P1 and a second zone 102 having a second pressure P2 of the borehole. The annular barrier comprises a tubular part 7 adapted to be mounted as part of the second well tubular metal structure 104 and having an inside 14 being the inside of the second well tubular metal structure and thus in fluid communication therewith. The annular barrier 1 further comprises the expandable metal sleeve 8 surrounding the tubular part 7 and having an inner sleeve face 9 facing the tubular part, and an outer sleeve face 10 facing the wall 5 of the borehole 6. The outer sleeve face abuts the wall in the expanded position shown in FIG. 3. Each end 12 of the expandable metal sleeve 8 is connected with the tubular part 7, creating an annular space 15 between the inner sleeve face 9 of the expandable metal sleeve and the tubular part. The annular barrier 1 has a first opening 16 which is in fluid communication with the inside 14 of the second well tubular metal structure 104 and thus in fluid communication with the tubular part. The annular barrier 1 further has a second opening 17 which is in fluid communication with the annular space 15. When the inside 14 of the tubular part 7 is pressurised to the third pressure, the valve assembly changes condition from the first condition to the second condition, and the fluid flows into the annular space 15, thereby expanding the expandable metal sleeve 8 to the expanded position, as shown in FIG. 3.

Figure 4:
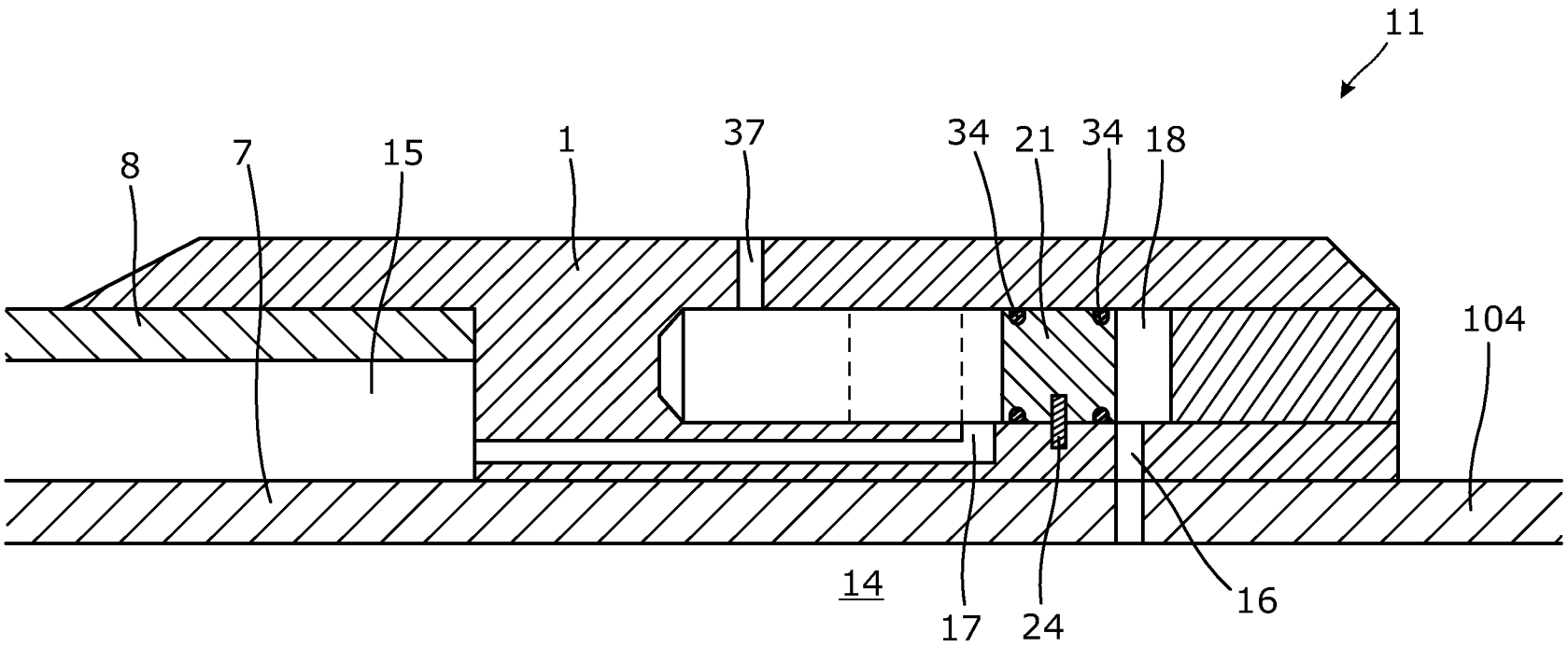
FIG. 4 shows a cross-sectional view of a valve assembly.

In FIG. 4, the first condition is a first position and the second condition is a second position. The valve assembly comprises a first piston 21 moving in a first bore 18 between the first position and the second position. The first piston is maintained in the first position by means of the breakable element 24. The first bore has a first opening 16 in fluid communication with an inside 14 of the second well tubular metal structure 104, and a second opening 17 in fluid communication with the annular space 15. After cementing, the pressure inside the second well tubular metal structure 104 is increased to the third pressure and the breakable element 24 breaks, the first piston 21 moves to the position illustrated by the dotted lines, and fluid communication between the first opening 16 and the second opening 17 is established, and when further pressurising, e.g. by maintaining the pressure or by further increasing the pressure, the expandable metal sleeve 8 of the annular barrier 1 is expanded, as shown in FIG. 1. Should the piston return, the sealing elements 34 seal off the first opening. The first bore 18 has a third opening 37 which is in fluid communication with the annulus 2 for venting of pressure in the annular space 15 to the annulus 2, when the first piston is in the first position and while running the second well tubular metal structure in the hole, so that the expandable metal sleeve 8 does not collapse.

Even though cleaning and cementing is performed above the intended pressure, the annular barriers do not expand unintentionally when having a valve assembly in a closed condition while cleaning and cementing as long as the first pressure and the second pressure do not exceed the third pressure. Thus, it is ensured that e.g. the cementing can be performed as intended without prematurely expanded annular barriers blocking the annulus. Thus, the cement is run with pressure activated valves opposite the expansion opening in the annular barrier in its closed position. The valves are activated/opened when a third pressure is reached, i.e. breaking a shear pin, so that the valve does not open before the cement job has ended so that the annular barrier is not expanded too soon.

The annular barrier 1 of FIG. 3 further comprises the first bore 18 having a bore extension and comprising a first bore part 19 having a first inner diameter and a second bore part 20 having an inner diameter which is larger than that of the first bore part. The first opening 16 and the second opening 17 are arranged in the first bore part 19 and they are displaced along the bore extension. The annular barrier 1 further comprises a first piston 21 arranged in the first bore 18. The piston comprises a first piston part 22 having an outer diameter substantially corresponding to the inner diameter of the first bore part 19. The first piston comprises a second piston part 23 having an outer diameter substantially corresponding to the inner diameter of the second bore part 20. The annular barrier 1 further comprises a rupture element 24C which prevents movement of the first piston 21 until a predetermined pressure in the bore 18 is reached. The strength of the rupture element 24C is set based on a predetermined pressure acting on the areas of the ends of the piston, and thus, the difference in outer diameters results in a movement of the first piston when the pressure exceeds the predetermined pressure. The first piston 21 comprises a fluid channel 25 being a through bore providing fluid communication between the first bore part 19 and the second bore part 20.

By having a first piston with a fluid channel, fluid communication between the first bore part and the second bore part is provided so that upon rupture of the rupture element, the piston can move, which leads to fluid communication to the inside of the tubular part being closed off. In this way, a simple solution without further fluid channels is provided, and due to the fact that the second piston part has an outer diameter which is larger than that of the first piston part, the surface area onto which fluid pressure is applied is larger than that of the first piston part. Thus, the pressure moves the piston when the annular barrier is expanded and pressure has been built up for breaking the rupture element 24C, which allows the piston to move.

Figure 6A:
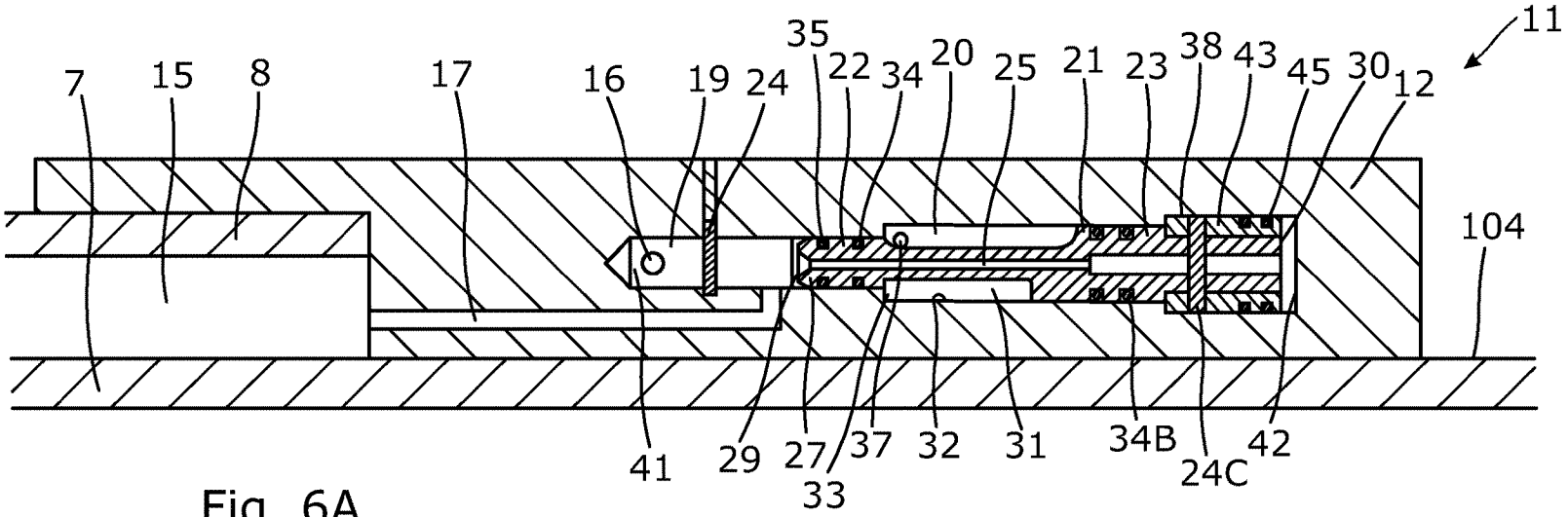
FIG. 6A shows a cross-sectional view of another valve assembly, in which the piston is in its initial position.
Figure 6B:
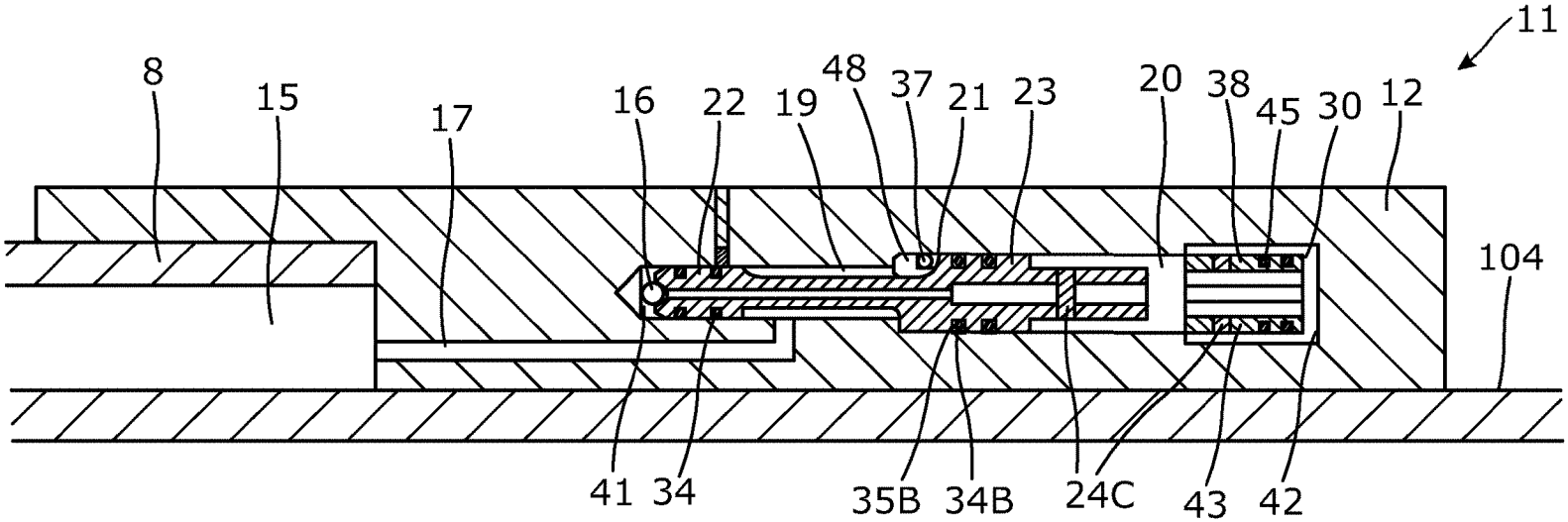
FIG. 6B shows the piston of FIG. 6A in its closed position.

In FIG. 3, the rupture element 24C is a shear disc and the piston has not moved to its closed position yet, and in FIGS. 6A and 6B the rupture element 24C is also a shear pin. In FIG. 6A, the shear pin is intact and extends through the first piston and the inserts 43, and in FIG. 6B, the shear pin is sheared and the piston is allowed to move, and the inserts 43 have moved towards the centre of the bore 18. Depending on the isolation solution required to provide isolation downhole, the rupture element 24C is selected based on the expansion pressure so as to break at a pressure higher than the expansion pressure but lower than the pressure rupturing the expandable metal sleeve or jeopardising the function of other completion components downhole. In FIG. 3, the bore 18 and the piston 21 are arranged in a connection part 26 connecting the expandable metal sleeve 8 with the tubular part 7. In another embodiment, the bore 18 and piston 21 are arranged in the tubular part 7.

In FIG. 6A, the breakable element 24, e.g. a shear disc, is arranged in the first bore part 19 between the first opening 16 and the second opening 17 so that when reaching the third pressure, the breakable element 24 breaks and the valve assembly changes from the first condition shown in FIG. 6A to the second condition. After expansion of the annular barrier, the first piston 21 moves to the position shown in FIG. 6B where also the rupture element 24C is broken.

In FIGS. 6A and 6B, the first piston 21 has a first piston end 27 at the first piston part 22 and a second piston end 28 at the second piston part 23. The first piston end has a first piston face 29 and the second piston end has a second piston face 30. Furthermore, the second piston face 30 has a face area which is larger than the face area of the first piston face 29 in order to move the piston 21 towards the first bore part 19. The difference in face areas creates a difference in the force acting on the piston 21, causing the piston to move to close off the fluid communication between the first opening 16 and the second opening 17.

As shown in FIG. 6A, the first piston part 22 extends partly into the second bore part 20 in an initial position of the piston 21 and forms an annular space 31 between the piston and an inner wall 32 of the bore. When the fluid presses onto the second piston face 30, the movement of the piston 21 stops when the second piston part 23 reaches the first bore part 19, causing the second piston part to rest against an annular face 33 created by the difference between the inner diameters of the first bore part 19 and the second bore part 20, which is shown in FIG. 6B. The annular space 31 is fluidly connected with the annulus between the well tubular structure and the inner wall of the borehole and is thus pressure-relieved via a third opening 37, thereby allowing the movement of the piston 21.

The first piston part 22 comprises two annular sealing elements 34, each arranged in an annular groove 35 in the first piston part 22. The annular sealing elements 34 are arranged at a predetermined distance and are thereby arranged at opposite sides of the first opening 16 in a closed position of the piston 21, as shown in FIG. 6B. Furthermore, the second piston part 23 comprises two sealing elements 34B arranged in an annular groove 35B.

In FIGS. 6A and 6B, the annular barrier further comprises a locking element 38 adapted to mechanically lock the piston 21 when the piston is in the closed position, blocking the first opening 16, as shown in FIG. 6B.

In FIG. 6A, the second piston part 23 comprises the locking element 38 arranged at the second piston end 28 of the piston 21. The locking element 38, shaped like collets, is released when the piston moves to block the first opening 16, and the collets thus move radially inwards, as shown in FIG. 6B.

When using a mechanical lock to prevent backwards movement of the piston, there is no need for a check valve to prevent the return of the piston when the pressure inside the annular barrier increases. In this way, the risk of dirt preventing closure of the check valve and the risk that the pressure increases in the annular space of the barrier, forcing the piston to return thereby providing fluid communication from the inside of the tubular part again are eliminated. In the known solutions using check valves, the expandable metal sleeve has a potential risk of breaking or rupturing when the formation is fracked with colder fluids, such as seawater. By permanently blocking the fluid communication between the annular space and the inside of the well tubular metal structure, the expandable metal sleeve will not undergo such large changes in temperature and pressure, which substantially reduces the risk of rupturing.

Figure 5:
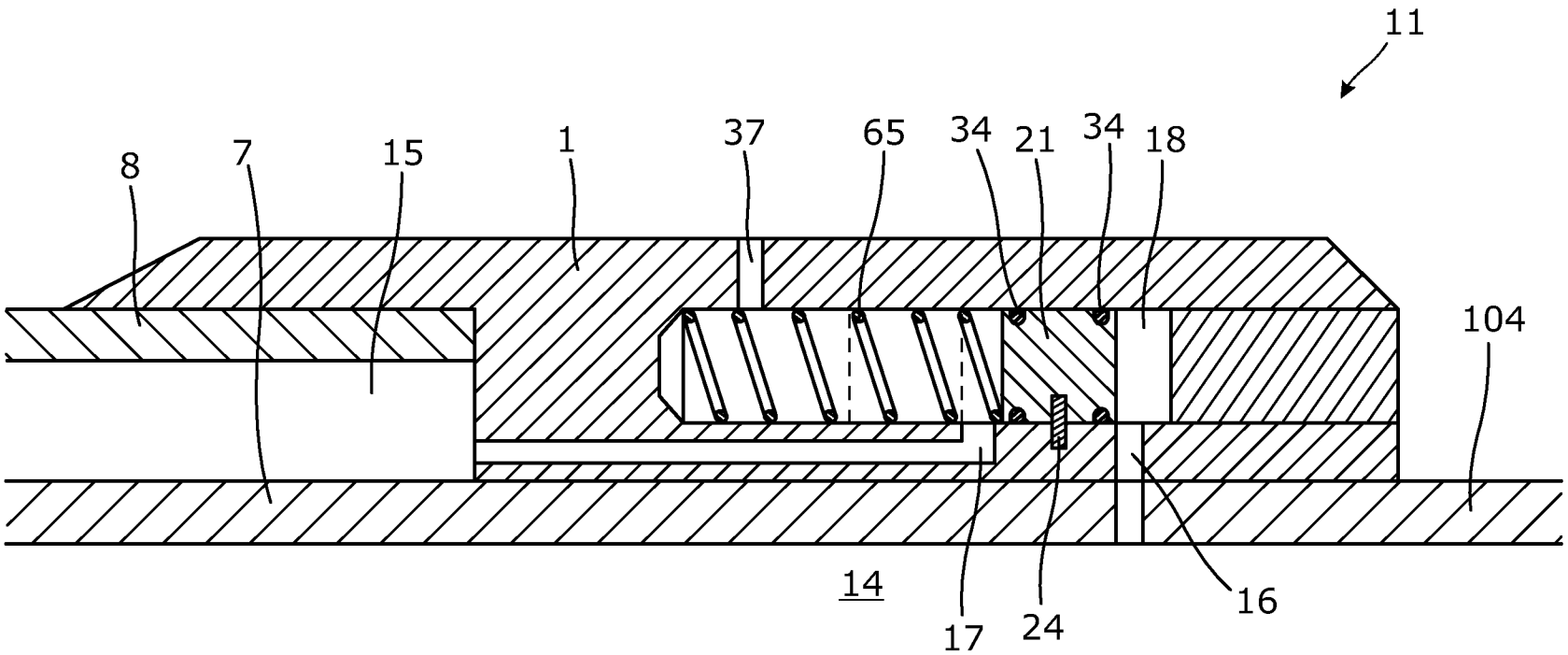
FIG. 5 shows a cross-sectional view of another valve assembly.

In FIG. 5, the valve assembly comprises a spring element 65, which is arranged in the first bore 18 and configured to be compressed when the first piston 21 moves from the first position to the second position. After the expansion of the expandable metal sleeve has ended, the compressing force of the spring element pushes the first piston to return to its first position so that the annular space 15 is brought in fluid communication with the annulus for equalising the pressure inside the space with the pressure in the annulus. The third opening may also be fluidly connected with a shuttle valve having a first outlet in fluid communication with the first zone (shown in FIG. 3) and a second outlet in fluid communication with a second zone so that space can be equalised with the highest pressure in either one of the first zone or the second zone.

Figure 7:
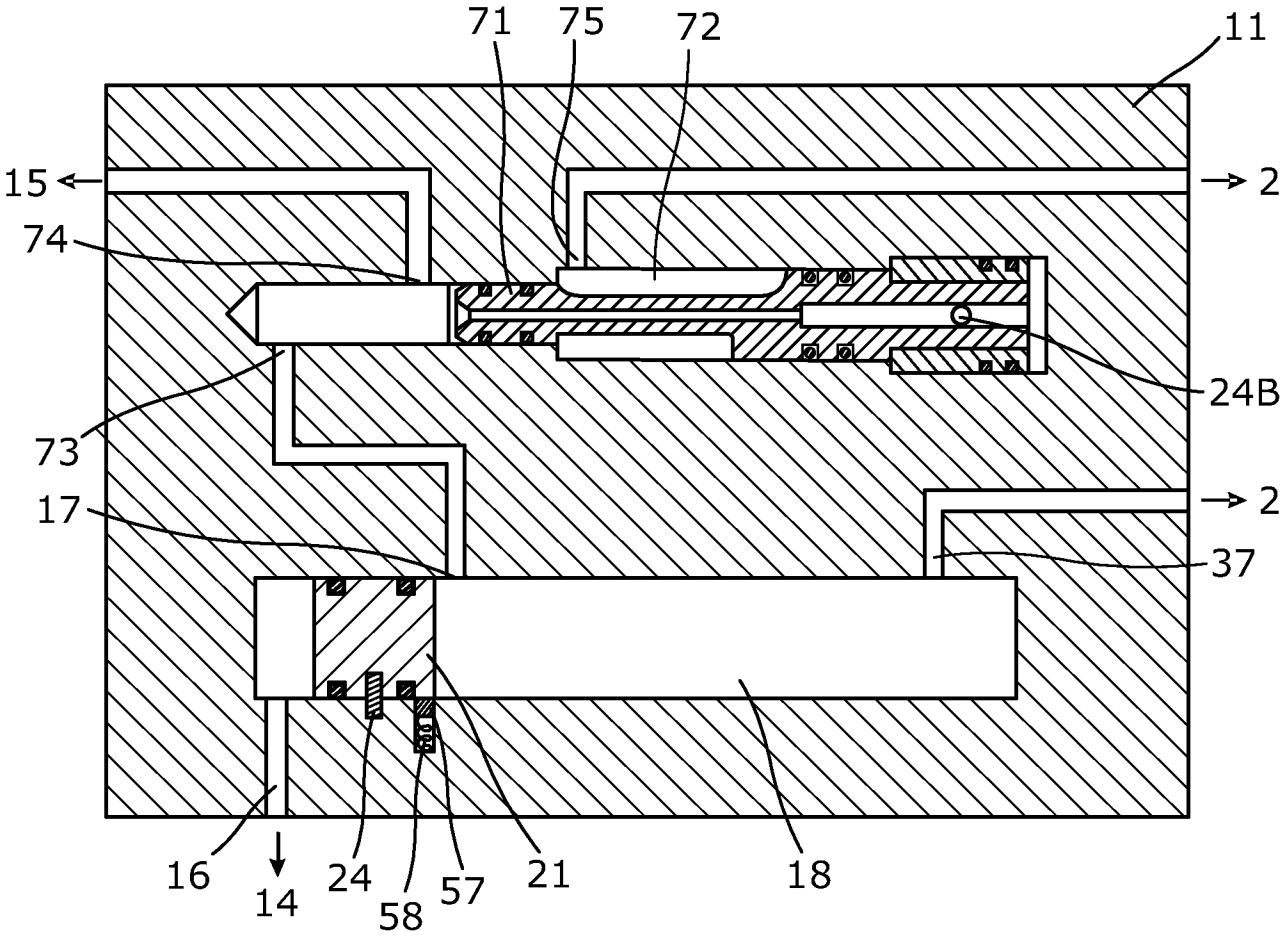
FIG. 7 shows an illustration in a partly cross-sectional view of yet another valve assembly.

In the illustration of FIG. 7, the valve assembly is illustrated with all fluid channels in the same plane for easing the understanding. However, this is of course not necessarily the case when arranging the valve assembly on the outer face of the tubular part. The valve assembly has a second piston 71 moving in a second bore 72 between a first position and a second position. The second bore has a first opening 73, which is in fluid communication with the second opening 17 of the first bore 18. The second bore has a second opening 74, which is in fluid communication with the annular space 15. When running the second well tubular metal structure in hole, the second piston 71 is in the first position, i.e. an open position, but the first piston 21 is in its first and closed position so that no fluid is permitted to flow into the second bore 72 until the third pressure is reached. But while RIH, the space 15 is equalised through openings 74, 73, 17 and 37 with the annulus 2. When the third pressure is reached, the breakable element 24 breaks due to the pressure difference between the annulus and the inside 14 of the second well tubular metal structure, and the first piston 21 moves to its second position between the second opening 17 and the third opening 37 enabling fluid communication between the first opening 16 and the space 15 through openings 17, 73 and 74. In the second position of the first piston 21, the second opening 17 is fluidly disconnected from the third opening 37. After the expansion of the expandable metal sleeve, the second piston 71 moves as described in relation to the first piston in FIGS. 6A and 6B, and fluid communication is provided between openings 74 and 75 for equalising the pressure in the space with the pressure in the annulus, while permanently closing the fluid communication between openings 74 and 73, and thus disconnecting fluid communication between the space 15 and the inside 14 of the second well tubular metal structure.

Thus, the second bore has the third opening 75, which is in fluid communication with the annulus 2 for venting of pressure in the annular space 15 to the annulus when the second piston 71 is in the second position. The third opening 75 may be in fluid communication with the shuttle valve, described above, for equalising the pressure in the space with the highest pressure in either the first zone or the second zone. Thus, the valve assembly has a second breakable element 24B equal to the rupture element 24C for maintaining the second piston 71 in the first position as described above.

As can be seen in FIGS. 1 and 2, the second well tubular metal structure comprises a plurality of annular barriers and an inflow control device 108 is arranged between two adjacent annular barriers for allowing production fluid into the well tubular metal structure and further up the production tubing 105. When cleaning and cementing, the pressure may be approximately the same so that the first pressure is substantially equal to the second pressure.

Displacement of cement is performed by displacing a wiper plug 66. The wiper plug 66 can be used as a bottom plug in order that the cement pushes the wiper plug forward in the well and the wiper plug 66 seats in the second end 54 of the second well tubular metal structure, as shown in FIG. 1. The system 100 may further comprise a top wiper plug 68, as shown in FIG. 2, which top wiper plug is arranged on top of the cement wiping the cement off the inner face of the second well tubular metal structure. The completion method may further comprise introducing displacement fluid, such as brine or similar light fluid, on top of the cement, e.g. on top of the top wiper plug, to displace the cement through the second well tubular metal structure. Light fluid as displacement fluid is used so that it can easily be displaced later. The completion method may further comprise the introduction of heavy fluid on top of light weight displacement fluid to be able to control the well later on. The completion method further comprises determining the first pressure, e.g. based on cement type, the annulus size and height and thus the distance created between the wall of the borehole and the outer face of the second well tubular metal structure.

In FIG. 7, the valve assembly 11 comprises a retainer element 57, in the first bore, energised with a retainer spring 58 so that when the first piston 21 moves past the retainer element 57 and the second opening 17, the retainer spring 58 pushes the retainer element 57 to project into the first bore 18, hindering the first piston 21 from returning.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A completion method for completing a well having a top, comprising:

drilling a borehole below a first well tubular metal structure in the well, circulating mud at least partly while drilling the borehole, providing a second well tubular metal structure having at least one unexpanded annular barrier having a tubular part surrounded by an expandable metal sleeve, expandable by means of pressurised fluid from within the second well tubular metal structure through a valve assembly into an annular space between the tubular part and the expandable metal sleeve, the valve assembly including a breakable element being exposed to the pressurized fluid via a first opening in the second well tubular metal structure, the second well tubular metal structure having a first end closest to the top and a second end, the valve assembly having a first condition in which fluid communication between an inside of the second well tubular metal structure and the space is disconnected, and having a second condition allowing fluid communication between the inside of the second well tubular metal structure and the annular space, running the second well tubular metal structure into the well to a position at least partly below the first well tubular metal structure, circulating cleaning fluid at a first pressure out through the second end to remove at least part of the mud, displacing cement at a second pressure down through the second well tubular metal structure and out through the second end into an annulus between the second well tubular metal structure and a wall of the borehole, pressurising the inside of the second well tubular metal structure to a third pressure above the first pressure and the second pressure thus introducing the pressurized fluid into the first opening at the third pressure and breaking the breakable element in the valve assembly, which causes the valve assembly to change from the first condition to the second condition, and further pressurising the inside of the second well tubular metal structure, expanding the expandable metal sleeve to abut the wall of the borehole.

2. The completion method according to claim 1, wherein the valve assembly comprises a first piston movable in a first bore from the first condition to the second condition, the first piston being maintained in the first condition by means of the breakable element.

3. The completion method according to claim 2, further comprising running of the second well tubular metal structure being performed by connecting a drill pipe to the first end of the second well tubular metal structure.

4. The completion method according to claim 3, further comprising disconnecting the drill pipe subsequent to expanding the expandable metal sleeve.

5. The completion method according to claim 2, further comprising introducing displacement fluid on top of the cement or the wiper plug to displace the cement.

6. The completion method according to claim 2, further comprising running a production tubing into the well to a position partly overlapping or above the second well tubular metal structure.

7. The completion method according to claim 2, wherein while running the second well tubular metal structure the annular space is vented to the annulus.

8. The completion method according to claim 1, wherein displacing cement is performed by displacing a wiper plug.

9. The completion system according to claim 1, wherein the valve assembly includes a valve that is positioned to receive the pressurized fluid via the first opening and controls whether the pressurized fluid is permitted to enter the annular space, the valve being connected to the breakable element.

10. The completion system according to claim 9, wherein the valve is not a check valve.

11. The completion system according to claim 9, wherein the first opening is in a side wall of the second well tubular metal structure, the first opening running substantially transverse to a longitudinal axis of the second well tubular metal structure.

12. A completion system for completing a well having a top, comprising:

a borehole, a first well tubular metal structure, a second well tubular metal structure comprising at least one annular barrier having a tubular part mounted as part of the second well tubular metal structure and surrounded by an expandable metal sleeve, expandable by means of pressurised fluid from within the second well tubular metal structure through a valve assembly into an annular space between the tubular part and the expandable metal sleeve, the valve assembly including a breakable element therein being exposed to the pressurized fluid via a first opening in the second well tubular metal structure, the second well tubular metal structure having a first end closest to the top and a second end, the valve assembly having a first condition in which fluid communication between an inside of the second well tubular metal structure and the annular space is disconnected, and having a second condition allowing fluid communication between the inside of the second well tubular metal structure and the annular space, a first delivering means for delivering cleanout fluid at a first pressure through the second well tubular metal structure, and a second delivering means for delivering cement at a second pressure through the second well tubular metal structure, wherein the breakable element is exposed to the pressurized fluid via the first opening and is breakable at a third pressure being higher than that of the first pressure and of the second pressure, enabling the valve assembly to change from the first condition to the second condition.

13. The completion system according to claim 12, wherein the first condition is a first position and the second condition is a second position, and the valve assembly comprises a first piston moving in a first bore between the first position and the second position, the first piston being maintained in the first position by means of the breakable element, and the first bore having a first opening in fluid communication with an inside of the second well tubular metal structure, and a second opening in fluid communication with the annular space.

14. The completion system according to claim 13, wherein the first bore has a third opening in fluid communication with the annulus for venting of pressure in the annular space to the annulus when the first piston is in the first position.

15. The completion system according to claim 13, wherein the valve assembly has a second piston moving in a second bore between a first position and a second position, the second bore having a first opening in fluid communication with the second opening of the first bore, and the second bore having a second opening in fluid communication with the annular space.

16. The completion system according to claim 15, wherein the second bore has a third opening in fluid communication with the annulus for venting of pressure in the annular space to the annulus when the second piston is in the second position.

17. The completion system according to claim 15, the valve assembly having a second breakable element for maintaining the second piston in the first position.

18. A completion system for completing a well having a top, comprising:

a borehole, a first well tubular metal structure, a second well tubular metal structure comprising at least one annular barrier having a tubular part mounted as part of the second well tubular metal structure and surrounded by an expandable metal sleeve, expandable by means of pressurised fluid from within the second well tubular metal structure through a valve assembly into an annular space between the tubular part and the expandable metal sleeve, the second well tubular metal structure having a first end closest to the top and a second end, the valve assembly having a first condition in which fluid communication between an inside of the second well tubular metal structure and the annular space is disconnected, and having a second condition allowing fluid communication between the inside of the second well tubular metal structure and the annular space, a first delivering means for delivering cleanout fluid at a first pressure through the second well tubular metal structure, and a second delivering means for delivering cement at a second pressure through the second well tubular metal structure, wherein the valve assembly comprises a breakable element breakable at a third pressure being higher than that of the first pressure and of the second pressure, enabling the valve assembly to change from the first condition to the second condition, and wherein the first condition is a first position and the second condition is a second position, and the valve assembly comprises a first piston moving in a first bore between the first position and the second position, the first piston being maintained in the first position by means of the breakable element, and the first bore having a first opening in fluid communication with an inside of the second well tubular metal structure, and a second opening in fluid communication with the annular space.

19. The completion system according to claim 18, wherein the first bore has a third opening in fluid communication with the annulus for venting of pressure in the annular space to the annulus when the first piston is in the first position.

20. The completion system according to claim 18, wherein the valve assembly has a second piston moving in a second bore between a first position and a second position, the second bore having a first opening in fluid communication with the second opening of the first bore, and the second bore having a second opening in fluid communication with the annular space.

21. The completion system according to claim 20, wherein the second bore has a third opening in fluid communication with the annulus for venting of pressure in the annular space to the annulus when the second piston is in the second position.

22. The completion system according to claim 20, the valve assembly having a second breakable element for maintaining the second piston in the first position.

* * * * *